US012604987B2

(12) United States Patent
Li et al.

(10) Patent No.: US 12,604,987 B2
(45) Date of Patent: Apr. 21, 2026

(54) SOFA EXTENSION APPARATUS

(71) Applicant: DEWERTOKIN TECHNOLOGY GROUP CO., LTD., Jiaxing (CN)

(72) Inventors: Long Li, Jiaxing (CN); Pengfei He, Jiaxing (CN); Liming Yang, Jiaxing (CN); Bin Shen, Jiaxing (CN); Weiyao Zhou, Jiaxing (CN); Kangming Tao, Jiaxing (CN); Guowei Wang, Jiaxing (CN); Qiqi Ye, Jiaxing (CN); Guangjiao Zhang, Jiaxing (CN); Shuangbo Liu, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 372 days.

(21) Appl. No.: 18/273,627

(22) PCT Filed: Jan. 21, 2022

(86) PCT No.: PCT/CN2022/073278

§ 371 (c)(1),
(2) Date: Jul. 21, 2023

(87) PCT Pub. No.: WO2022/156781

PCT Pub. Date: Jul. 28, 2022

(65) Prior Publication Data

US 2024/0298805 A1 Sep. 12, 2024

(30) Foreign Application Priority Data

Jan. 22, 2021 (CN) ..... 202120180579.X

(51) Int. Cl.
*A47C 7/50* (2006.01)

(52) U.S. Cl.
CPC ..... *A47C 7/5062* (2018.08); *A47C 7/5068* (2018.08)

(58) Field of Classification Search
CPC .... A47C 7/5062; A47C 7/5068; A47C 7/0355
See application file for complete search history.

(56) References Cited

U.S. PATENT DOCUMENTS 5,527,095 A * 6/1996 Marshall ..... A47C 1/0352 297/85 L
8,016,348 B2 * 9/2011 Hoffman ..... A47C 3/0255 297/85 M (Continued)

FOREIGN PATENT DOCUMENTS

CN 202932424 U 5/2013
CN 104622084 A 5/2015

(Continued)

OTHER PUBLICATIONS

International Search Report for corresponding application PCT/CN2022/073278 filed Jan. 21, 2022; Mail date Mar. 21, 2022.

(Continued)

*Primary Examiner* — David R Dunn
*Assistant Examiner* — Jessica Kathryn Thompson
(74) *Attorney, Agent, or Firm* — CANTOR COLBURN LLP

(57) ABSTRACT

Provided is a sofa extension apparatus. The sofa extension apparatus includes a sofa frame, extension brackets, a first linkage rod, a second linkage rod and a linear drive assembly. Each extension bracket includes a sofa fixing member and a leg portion extension assembly, the sofa fixing member is connected to the sofa frame, the leg portion extension assembly is rotatably connected to a front end of the sofa fixing member. Two ends of the first linkage rod are fixedly connected to rear ends of two sofa fixing members respectively. Two ends of the second linkage rod are connected to two leg extension assemblies respectively. The linear drive assembly is configured to drive the first linkage rod and the (Continued)

second linkage rod to move relative to each other, so as to enable the two extension brackets to be extended or retracted.

9 Claims, 3 Drawing Sheets

(56) References Cited

U.S. PATENT DOCUMENTS

| | | | | |
|---|---|---|---|---|
| 10,299,597 | B1 * | 5/2019 | Crum | A47C 1/0355 |
| 11,617,446 | B2 * | 4/2023 | Zhang | A47C 7/5068 297/423.26 |
| 11,744,369 | B2 * | 9/2023 | Murphy | A47C 1/03211 297/69 |
| 2011/0248547 | A1 | 10/2011 | LaPointe et al. | |
| 2012/0049606 | A1 | 3/2012 | Lawson et al. | |

FOREIGN PATENT DOCUMENTS

| | | | |
|---|---|---|---|
| CN | 105394952 | A | 3/2016 |
| CN | 109924750 | A | 6/2019 |
| CN | 110292272 | A | 10/2019 |
| CN | 110693227 | A | 1/2020 |
| CN | 210330014 | U | 4/2020 |
| CN | 111972901 | A | 11/2020 |
| CN | 214258670 | U | 9/2021 |
| CN | 214258970 | U | 9/2021 |

OTHER PUBLICATIONS

European Search Report for corresponding application EP22742260; Report date Oct. 29, 2024.

* cited by examiner

SOFA EXTENSION APPARATUS

CROSS-REFERENCE TO RELATED APPLICATION

This is a National stage application, filed under 37 U.S.C. 371, of International Patent Application NO. PCT/CN2022/073278, filed on Jan. 21, 2022, which is based on and claims priority to Chinese Patent Application No. 202120180579.X, filed with the China National Intellectual Property Administration (CNIPA) on Jan. 22, 2021, the disclosure of which is incorporated herein by reference in its entirety.

TECHNICAL FIELD

The present disclosure relates to the field of furniture, for example, a sofa extension apparatus.

BACKGROUND

In order to satisfy the function diversification of a modern sofa, a current sofa or seat can achieve the stable transformation of a sitting posture, a leisure posture and a lying posture so as to satisfy various requirements of the sitting posture, the leisure posture and the lying posture. The above-described sofa is designed by combining methods such as ergonomics, and planar bar system kinematics, so that the sofa is more comfortable and beneficial to the blood circulation of the body.

In the existing art, a seat frame of a sofa extension apparatus is relatively thick, and an electric motor and part of iron frames are exposed at the bottom of the sofa in installation, whereby the aesthetic effect of the sofa is affected.

SUMMARY

The present disclosure provides a sofa extension apparatus, which can avoid a situation that an electric motor and part of iron frames are exposed at the bottom of a sofa and thus the aesthetic effect of the sofa is affected.

The present disclosure adopts the following technical solutions.

A sofa extension apparatus includes a sofa frame, two extension brackets, a first linkage rod, a second linkage rod and a linear drive assembly. Each of the two extension brackets includes a sofa fixing member and a leg portion extension assembly, the sofa fixing member is connected to the sofa frame, the leg portion extension assembly is rotatably connected to a front end of the sofa fixing member. Each of two ends of the first linkage rod is fixedly connected to a respective one of rear ends of two sofa fixing members. Each of two ends of the second linkage rod is connected to a respective one of two leg extension assemblies. The linear drive assembly is configured to drive the first linkage rod and the second linkage rod to move relative to each other, so as to enable the two extension brackets to be extended or retracted. An angle of inclination between the sofa fixing member and a horizontal plane is 5° to 10°, to enable the linear drive assembly to be always above a lower surface of the sofa frame.

REFERENCE LIST

Figure 1:
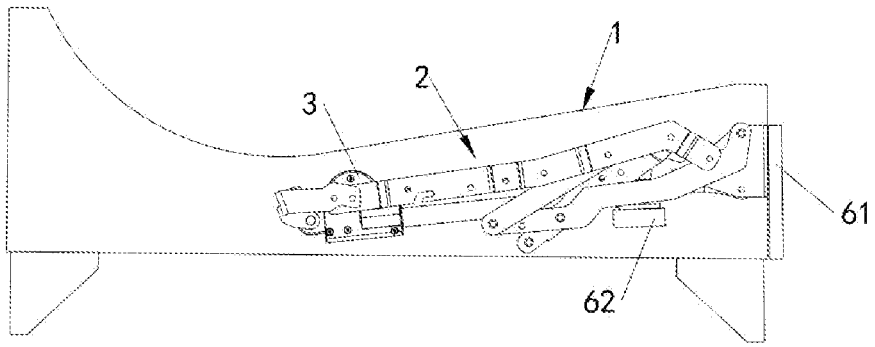
FIG. 1 is a side state view of a sofa extension apparatus in a normal fully retracted state according to an embodiment of the present disclosure.

1 sofa frame
2 extension bracket
21 sofa fixing member
211 mounting hole
212 mounting clamping slot
22 leg portion extension assembly
221 first connecting rod
222 second connecting rod
2221 second limiting slot
223 third connecting rod
224 fourth connecting rod
225 first limiting slot 2241
225 first footrest frame
226 footrest support member
227 second footrest frame
3 linear drive assembly
41 first linkage rod
42 second linkage rod
421 groove
43 first connecting member
44 second connecting member
51 first rotation shaft
52 second rotation shaft
53 third rotation shaft
54 fourth rotation shaft
55 fifth rotation shaft
56 sixth rotation shaft
57 seventh rotation shaft
61 first footrest plate
62 second footrest plate
71 first limiting member
72 second limiting member
73 third limiting member

DETAILED DESCRIPTION

As shown in FIGS. 1 to 4, this embodiment provides a sofa extension apparatus. The sofa extension apparatus includes a sofa frame 1, two extension brackets 2, a first linkage rod 41, a second linkage rod 42, and a linear drive assembly 3. Each extension bracket 2 includes a sofa fixing member 21 and a leg portion extension assembly, the sofa fixing member 21 is connected to the sofa frame 1, and the leg portion extension assembly is rotatably connected to a front end of the sofa fixing member 21. Two ends of the first linkage rod 41 are fixedly connected to rear ends of two sofa fixing members 21 respectively. Two ends of the second linkage rod 42 are connected to two leg extension assemblies respectively. The linear drive assembly 3 is configured to drive the first linkage rod 41 and the second linkage rod 42 to move relative to each other, so as to enable the two extension brackets 2 to be extended or retracted. An angle of inclination between the sofa fixing member 21 and a horizontal plane is 5° to 10°, to enable the linear drive assembly 3 to be always above a lower surface of the sofa frame 1. In this embodiment, the above-described sofa frame 1 is a wooden frame, and in other embodiments, the above-described sofa frame 1 may also be an iron frame.

In this embodiment, the angle of inclination between the sofa fixing member 21 and the horizontal plane is set to be 5° to 10° so that the linear drive assembly 3 is always above the lower surface of the sofa frame 1, thereby preventing the appearance effect of the sofa from being affected by the exposure of the linear drive assembly 3.

For example, a first connecting member 43 is fixedly connected to the first linkage rod 41, and a second connecting member 44 is connected to the second linkage rod 42. A fixed end of the linear drive assembly 3 is rotatably connected to the first connecting member 43, and a movable end of the linear drive assembly 3 is rotatably connected to the second connecting member 44.

For example, the first linkage rod 41 and the second linkage rod 42 are each a tube with a rectangular section. The second linkage rod 42 is provided with a groove 421, the groove 421 and the second connecting member 44 are located on two adjacent sides of the second linkage rod 42, and the first connecting member 43 is located on a lower side of the first linkage rod 41. When the extension brackets 2 are in a normal fully retracted state, the second connecting member 44 is located on a rear side of the second linkage rod 42.

In this embodiment, the fixed end of the linear drive assembly 3 is rotatably connected to the first connecting member 43 through a first rotation shaft, and the movable end of the linear drive assembly 3 is rotatably connected to the second connecting member 44 through a second rotation shaft. The above-described first rotation shaft and second rotation shaft may be a pin, a rotating bolt or the like, the first connecting member 43 and the first linkage rod 41 may be connected to each other by welding, sleeving, clamping or a screw; and the second connecting member 44 and the second linkage rod 42 may be connected to each other by welding, sleeving, clamping or a screw:

In other embodiments, the first linkage rod 41 and the second linkage rod 42 are each a tube with a rectangular section. The first connecting member 43 is located on a front side of the first linkage rod 41, and when the extension brackets 2 are in a normal fully retracted state, the second connecting member 44 is located on a rear side of the second linkage rod 42.

For example, the above-described leg portion extension assembly includes a first connecting rod 221, a second connecting rod 222, a third connecting rod 223, a fourth connecting rod 224, a first footrest frame 225, a footrest support member 226 and a second footrest frame 227. Two ends of the second linkage rod 42 is fixedly connected to two second connecting rods 222 respectively. A middle portion of the sofa fixing member 21 is rotatably connected to one end of the first connecting rod 221, another end of the first connecting rod 221 is rotatably connected to one end of the third connecting rod 223, another end of the third connecting rod 223 is rotatably connected to the first footrest frame 225 through a first rotation shaft 51. The front end of the sofa fixing member 21 is rotatably connected to one end of the second connecting rod 222, a middle portion of the second connecting rod 222 is rotatably connected to a middle portion of the third connecting rod 223, and another end of the second connecting rod 222 is rotatably connected to one end of the fourth connecting rod 224 through a second rotation shaft 52. Another end of the fourth connecting rod 224 is rotatably connected to the first footrest frame 225 through a third rotation shaft 53.

One end of the fourth connecting rod 224 is rotatably connected to one end of the footrest support member 226 through a fourth rotation shaft 54, another end of the footrest support member 226 is rotatably connected to a middle portion of the second footrest frame 227, and one end of the second footrest frame 227 is rotatably connected to the first footrest frame 225 through a fifth rotation shaft 55. The first rotation shaft 51, the third rotation shaft 53 and the fifth rotation shaft 55 are arranged in a triangular shape, and the second rotation shaft 52, the third rotation shaft 53 and the fourth rotation shaft 54 are distributed in sequence in an extending direction of the fourth connecting rod 224. The rotation of the second connecting rod 222 is capable of driving the first footrest frame 225 and the second footrest frame 227 to be extended or retracted, so that when the first footrest frame 225 and the second footrest frame 227 are in the normal fully retracted state, a front end surface of the first footrest frame 225 and a front end surface of the second footrest frame 227 form an included angle. By way of example, when the above-described extension brackets 2 are in the normal fully retracted state, the front end surface of the first footrest frame 225 and the front end surface of the second footrest frame 227 are substantially perpendicular to each other. For example, the front end surface of the first footrest frame 225 is mounted with a first footrest plate 61, the front end surface of the second footrest frame 227 is mounted with a second footrest plate 62, and an included angle between the first footrest plate 61 and the second footrest plate 62 is approximately 90°.

With the leg portion extension assembly provided in this embodiment, it is achieved that regardless of the state of the sofa extension apparatus, a height of the first footrest frame 225 from the ground and a height of the second footrest frame 227 from the ground are increased compared with the existing art, facilitating cleaning of the bottom of the sofa.

The above-described sofa extension apparatus is simple in structure, and a vertical height of the entire sofa extension apparatus is reduced when the first footrest frame and the second footrest frame are in the normal fully retracted state.

For example, the fourth connecting rod 224 is provided with a first limiting member 71, and the first limiting member 71 is located between the second rotation shaft 52 and the third rotation shaft 53. When the second footrest frame 227 is in the normal fully retracted state, the first limiting member 71 abuts against the second footrest frame 227, thereby preventing the second footrest frame 227 from protruding upwards under the action of an external force and thus causing the extension movement of the extension brackets 2 to be stuck.

Figure 2:
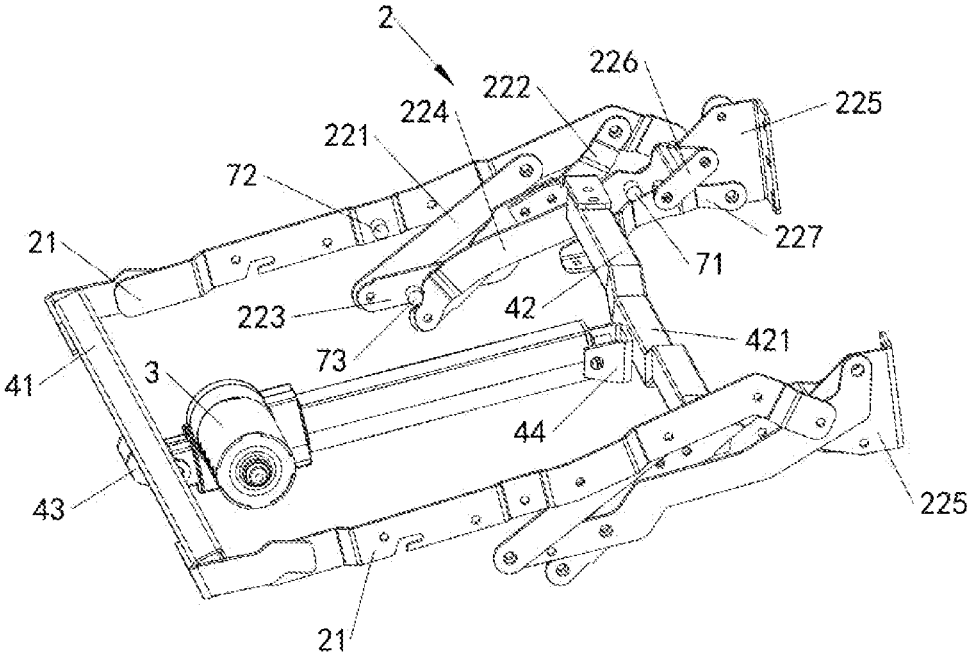
FIG. 2 is a schematic structural view of a sofa extension apparatus in a normal fully retracted state according to an embodiment of the present disclosure.
Figure 3:
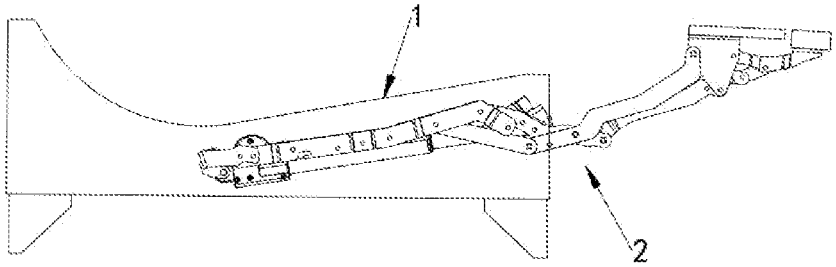
FIG. 3 is a side state view of a sofa extension apparatus in a normal fully extended state according to an embodiment of the present disclosure.
Figure 4:
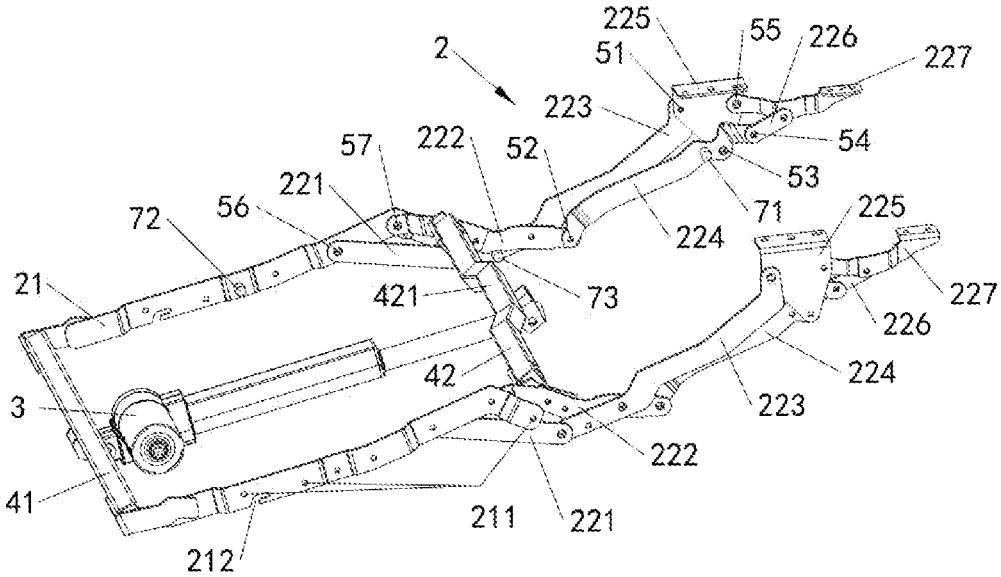
FIG. 4 is a structural state view of a sofa extension apparatus in a normal fully extended state according to an embodiment of the present disclosure.
Figure 5:
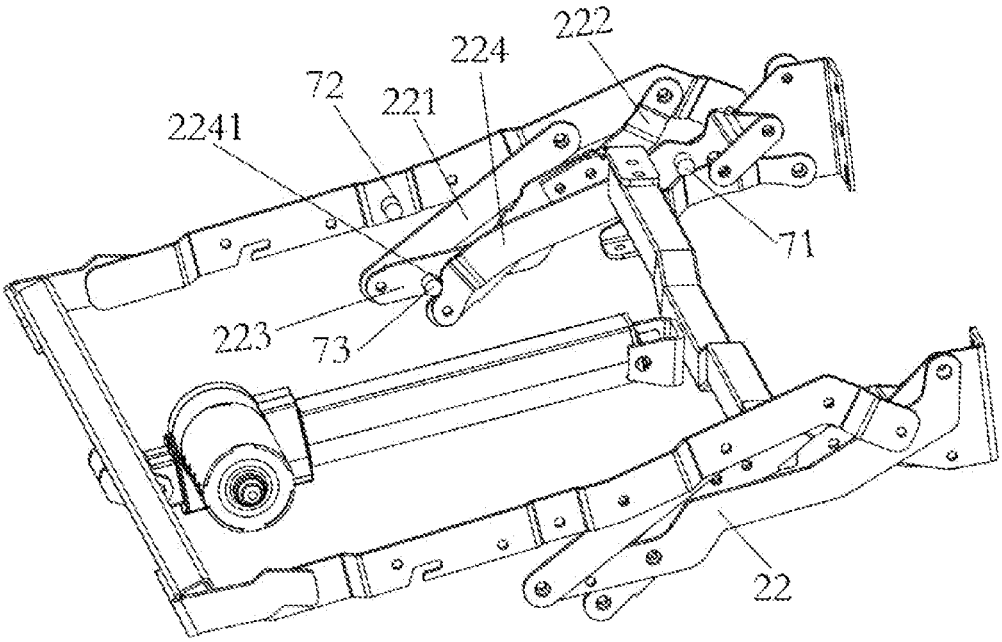
FIG. 5 is a schematic structural view of a sofa extension apparatus in a normal fully retracted state according to another embodiment of the present disclosure.
Figure 6:
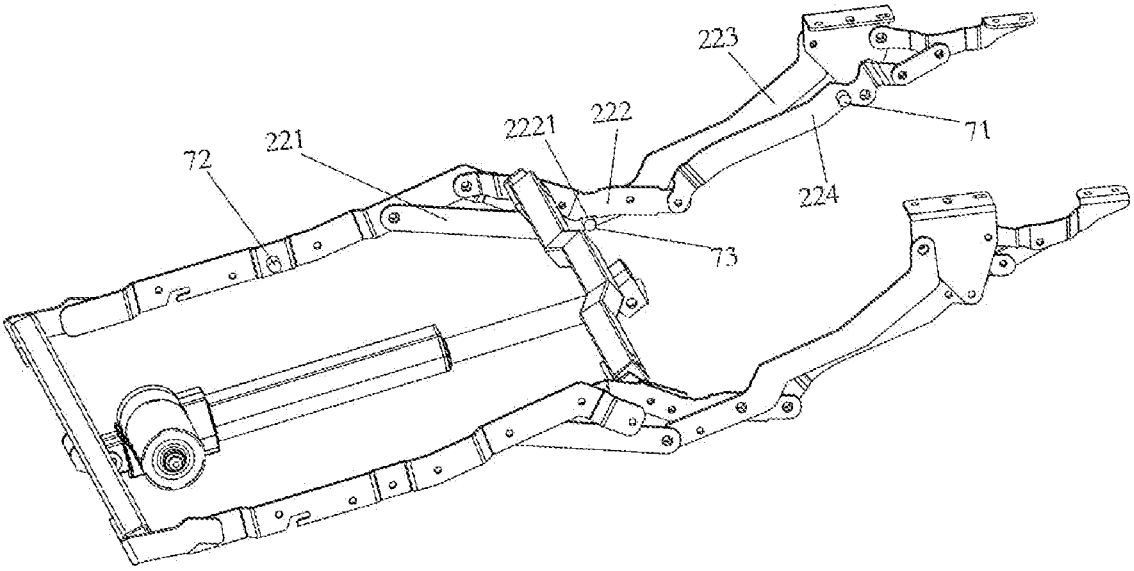
FIG. 6 is a schematic structural view of a sofa extension apparatus in a normal fully extended state according to another embodiment of the present disclosure.

For example, the middle portion of the sofa fixing member 21 is provided with a second limiting member 72, the first connecting rod 221 is rotatably connected to the sofa fixing member 21 through a sixth rotation shaft 56, the second connecting rod 222 is rotatably connected to the sofa fixing member 21 through a seventh rotation shaft 57, and the second limiting member 72, the sixth rotation shaft 56 and the seventh rotation shaft 57 are distributed in sequence in an extending direction of the sofa fixing member 21. When the extension brackets 2 are in the normal fully retracted state, as shown in FIGS. 1 and 2, the second limiting member 72 has no limiting effect, and when an external force continues to be applied so that the extension brackets 2 are retracted to an extreme position, the first connecting rod 221 abuts against the second limiting member 72. The second limiting member 72 is provided so that it is avoided that when the extension brackets 2 are retracted to the extreme position, the leg portion is tilted up and down as a whole under the action of an external force, thereby causing the extension movement of the extension brackets 2 to be stuck.

Two sofa fixing members 21 are in one-to-one correspondence with the extension brackets 2, each sofa fixing member 21 is provided with a mounting hole 211 and a mounting clamping slot 212. Three mounting holes 211 are provided. A bent portion is disposed at the front end of the sofa fixing member 21, and the bent portion is provided with a mounting hole 211. A mounting hole 211, the seventh rotation shaft 57, the sixth rotation shaft 56, a mounting hole 211, the mounting clamping slot 212 and a mounting hole 211 are arranged in sequence in the extending direction of the sofa fixing member 21. The sofa fixing member 21 is positioned via the mounting clamping slot 212 and a mounting post on the sofa frame 1, and then fasteners such as a bolt and a screw are passed through the mounting holes 211 on the sofa fixing member 21 and are connected to the sofa frame 1.

For example, the middle portion of the third connecting rod 223 is provided with a third limiting member 73, when the first footrest frame 225 and the second footrest frame 227 are in the normal fully retracted state, the third limiting member 73 abuts against the fourth connecting rod 224. During the retraction of the extension brackets 2, when the third limiting member 73 abuts against the fourth connecting rod 224, the retraction movement of the extension brackets 2 is terminated, thereby keeping in the normal fully retracted state. When an external force continues to be applied, the second limiting member 72 abuts against the first connecting rod 221, and the extension brackets 2 are retracted to the extreme position.

For example, the fourth connecting rod 224 is provided with a first limiting slot 2241, when the first footrest frame 225 and the second footrest frame 227 are in the normal fully retracted state, the third limiting member 73 abuts against a bottom wall of the first limiting slot 2241 to ensure the limiting effect of the third limiting member 73.

When the first footrest frame 225 and the second footrest frame 227 are in a normal fully extended state, the third limiting member 73 abuts against the second connecting rod 222. During the extension of the extension brackets 2, when the third limiting member 73 abuts against the second connecting rod 222, the extension movement of the extension brackets 2 is terminated.

For example, the second connecting rod 222 is provided with a second limiting slot 2221, when the first footrest frame 225 and the second footrest frame 227 are in the normal fully extended state, the third limiting member 73 abuts against a bottom wall of the second limiting slot 2241 to ensure the limiting effect of the third limiting member 73.

The "rotatably connected" mentioned in this embodiment is "rotatably riveted", and in other embodiments, the "rotatably connected" described above may also be "articulated".

An extension process of the sofa extension apparatus provided in this embodiment is as follows: when the linear drive assembly 3 moves, the linear drive assembly 3 drives the second connecting rod 222 by the second linkage rod 42 to rotate, the second connecting rod 222 drives the third connecting rod 223 and the fourth connecting rod 224 to rotate, the third connecting rod 223 and the fourth connecting rod 224 then push the first footrest frame 225 to rotate and extend, the fourth connecting rod 224 pushes the footrest support member 226 while pushing the first footrest frame 225, and the footrest support member 226 then supports the second footrest frame 227 to rotate and extend.

In the extension process of the sofa extension apparatus, when the third limiting member 73 on the third connecting rod 223 abuts against the second limiting slot 2221 on the second connecting rod 222, the extension process of the sofa extension apparatus is terminated. Conversely, in a retraction process of the sofa extension apparatus, the third limiting member 73 on the third connecting rod 223 abuts against the first limiting slot 2241 on the fourth connecting rod 224, and the retraction process of the sofa extension apparatus is terminated.

In the description of the present disclosure, it should be noted that orientations or position relations indicated by terms such as "center", "upper", "lower", "left", "right", "vertical", "horizontal", "in", "out", "front" and "back" are orientations or position relations shown based on the drawings. These orientations or position relations are intended merely to facilitate and simplify the description of the present disclosure and not to indicate or imply that a device or element referred to must have such particular orientations or must be configured or operated in such particular orientations. Thus, these orientations or position relations are not to be construed as limiting the present disclosure. For example, terms such as "front", "in front of" or "front side" refer to the direction of movement in which the leg portion extension assembly of the sofa extension apparatus of the present disclosure is extended, and terms such as "rear," "behind," or "rear side" refer to the direction of movement in which the leg portion extension assembly of the sofa extension apparatus of the present disclosure is retracted. Moreover, terms such as "first" and "second" are used only for the purpose of description and are not to be construed as indicating or implying relative importance. Terms such as "first position" and "second position" are two different positions.

In the description of the present disclosure, it should be noted that terms "mounted", "joined" and "connected" are to be understood in a broad sense unless otherwise expressly specified and limited. For example, the term "connected" may refer to "fixedly connected" or "detachably connected" or "integrally connected", may refer to "mechanically connected" or "electrically connected", or may refer to "connected directly", "connected indirectly through an intermediary" or "connected inside two elements". For those of ordinary skill in the art, specific meanings of the preceding terms in the present disclosure may be understood based on specific situations.

What is claimed is:

1. A sofa extension apparatus, comprising a sofa frame, two extension brackets, a first linkage rod, a second linkage rod and a linear drive assembly, wherein each of the two extension brackets comprises a sofa fixing member and a leg portion extension assembly, the sofa fixing member is connected to the sofa frame, the leg portion extension assembly is rotatably connected to a front end of the sofa fixing member, each of two ends of the first linkage rod is fixedly connected to a respective one of rear ends of two sofa fixing members, each of two ends of the second linkage rod is connected to a respective one of two leg extension assemblies, and the linear drive assembly is configured to drive the first linkage rod and the second linkage rod to move relative to each other, so as to enable the two extension brackets to be extended or retracted; and wherein an angle of inclination between the sofa fixing member and a horizontal plane is 5° to 10°, to enable the linear drive assembly to be always above a lower surface of the sofa frame;

wherein the leg portion extension assembly comprises a first connecting rod, a second connecting rod, a third connecting rod, a fourth connecting rod and a first footrest frame, and each of two ends of the second linkage rod is fixedly connected to a respective one of two second connecting rods;

a middle portion of the sofa fixing member is rotatably connected to a first end of the first connecting rod, a second end of the first connecting rod is rotatably connected to a first end of the third connecting rod, a second end of the third connecting rod is rotatably connected to the first footrest frame through a first rotation shaft;

a front end of the sofa fixing member is rotatably connected to a first end of the second connecting rod, a middle portion of the second connecting rod is rotatably connected to a middle portion of the third connecting rod, and a second end of the second connecting rod is rotatably connected to a first end of the fourth connecting rod through a second rotation shaft; and a second end of the fourth connecting rod is rotatably connected to the first footrest frame through a third rotation shaft;

wherein the leg portion extension assembly further comprises a footrest support member and a second footrest frame;

a second end of the fourth connecting rod is rotatably connected to a first end of the footrest support member through a fourth rotation shaft, a second end of the footrest support member is rotatably connected to a middle portion of the second footrest frame, an end of the second footrest frame is rotatably connected to the first footrest frame through a fifth rotation shaft, the first rotation shaft, the third rotation shaft and the fifth rotation shaft are arranged in a triangular shape, the second rotation shaft, the third rotation shaft and the fourth rotation shaft are distributed in sequence in an extending direction of the fourth connecting rod; and rotation of the second connecting rod is capable of driving the first footrest frame and the second footrest frame to be extended or retracted, so that when the first footrest frame and the second footrest frame are in a normal fully retracted state, a front end surface of the first footrest frame and a front end surface of the second footrest frame form an included angle;

wherein the front end surface of the first footrest frame is mounted with a first footrest plate, the front end surface of the second footrest frame is mounted with a second footrest plate, and an included angle between the first footrest plate and the second footrest plate is approximately 90°.

2. The sofa extension apparatus of claim 1, wherein a first connecting member is fixedly connected to the first linkage rod, and a second connecting member is connected to the second linkage rod; and a fixed end of the linear drive assembly is rotatably connected to the first connecting member, and a movable end of the linear drive assembly is rotatably connected to the second connecting member.

3. The sofa extension apparatus of claim 2, wherein the first linkage rod and the second linkage rod are each a tube with a rectangular section, the second linkage rod is provided with a groove, the groove and the second connecting member are located on two adjacent sides of the second linkage rod, and the first connecting member is located on a lower side of the first linkage rod; and when the extension brackets are in a normal fully retracted state, the second connecting member is located on a rear side of the second linkage rod.

4. The sofa extension apparatus of claim 2, wherein the first linkage rod and the second linkage rod are each a tube with a rectangular section, the first connecting member is located on a front side of the first linkage rod; and when the extension brackets are in a normal fully retracted state, the second connecting member is located on a rear side of the second linkage rod.

5. The sofa extension apparatus of claim 1, wherein the fourth connecting rod is provided with a first limiting member, the first limiting member is located between the second rotation shaft and the third rotation shaft; and when the second footrest frame is in the normal fully retracted state, the first limiting member abuts against the second footrest frame.

6. The sofa extension apparatus of claim 1, wherein the middle portion of the sofa fixing member is provided with a second limiting member, the first connecting rod is rotatably connected to the sofa fixing member through a sixth rotation shaft, the second connecting rod is rotatably connected to the sofa fixing member through a seventh rotation shaft, and the second limiting member, the sixth rotation shaft and the seventh rotation shaft are distributed in sequence in an extending direction of the sofa fixing member; and when the extension brackets are retracted to an extreme position, the first connecting rod abuts against the second limiting member.

7. The sofa extension apparatus of claim 1, wherein the middle portion of the third connecting rod is provided with a third limiting member, and when the extension brackets are in the normal fully retracted state, the third limiting member abuts against the fourth connecting rod; and when the extension brackets are in a normal fully extended state, the third limiting member abuts against the second connecting rod.

8. The sofa extension apparatus of claim 7, wherein the fourth connecting rod is provided with a first limiting slot; and When the extension brackets are in the normal fully retracted state, the third limiting member abuts against a bottom wall of the first limiting slot.

9. The sofa extension apparatus of claim 7, wherein the second connecting rod is provided with a second limiting slot, and when the extension brackets are in the normal fully extended state, the third limiting member abuts against a bottom wall of the second limiting slot.

* * * * *